US009860942B2

(12) United States Patent
Lee et al.

(10) Patent No.: US 9,860,942 B2
(45) Date of Patent: Jan. 2, 2018

(54) ORGANIC LIGHT EMITTING DIODE DISPLAY DEVICE

(71) Applicant: LG Display Co., Ltd., Seoul (KR)

(72) Inventors: Myoung-Soo Lee, Seoul (KR); Sun-Hee Lee, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 126 days.

(21) Appl. No.: 13/941,757

(22) Filed: Jul. 15, 2013

(65) Prior Publication Data

US 2014/0175972 A1 Jun. 26, 2014

(30) Foreign Application Priority Data

Dec. 24, 2012 (KR) ..... 10-2012-0151923

(51) Int. Cl.
*H05B 33/04* (2006.01)

(52) U.S. Cl.
CPC ..... *H05B 33/04* (2013.01)

(58) Field of Classification Search
CPC .... H05B 33/04; G09G 3/3648; H01L 27/124; H01L 27/1222
USPC ..... 313/512
See application file for complete search history.

(56) References Cited

U.S. PATENT DOCUMENTS

| | | | | |
|---|---|---|---|---|
| 2003/0168966 | A1 | 9/2003 | Kobayashi et al. | |
| 2004/0036405 | A1 | 2/2004 | Hwang | |
| 2005/0112408 | A1* | 5/2005 | Kobayashi et al. | 428/690 |
| 2006/0097633 | A1* | 5/2006 | Cho et al. | 313/512 |
| 2006/0267492 | A1* | 11/2006 | Oh H01L | 51/5246 313/512 |
| 2012/0161620 | A1* | 6/2012 | Song et al. | 313/512 |

FOREIGN PATENT DOCUMENTS

| | | | |
|---|---|---|---|
| CN | 1496543 | A | 5/2004 |
| CN | 1832222 | A | 9/2006 |
| CN | 101051675 | A | 10/2007 |

* cited by examiner

*Primary Examiner* — Bumsuk Won
*Assistant Examiner* — Jacob R Stern
(74) *Attorney, Agent, or Firm* — Birch, Stewart, Kolasch & Birch, LLP

(57) ABSTRACT

An organic light emitting diode (OLED) display device including a substrate having a display region and a non-display region surrounding the display region; an OLED on the substrate in the display region; an encapsulation substrate bonded to the substrate via an adhesive layer such that the encapsulation substrate and the substrate face each other; and a step-difference compensation portion in the non-display region and configured to compensate for a step difference between the display region and the non-display region.

20 Claims, 6 Drawing Sheets

ORGANIC LIGHT EMITTING DIODE DISPLAY DEVICE

This application claims the benefit of Korean Patent Application No. 10-2012-0151923, filed on Dec. 24, 2012, which is hereby incorporated by reference as if fully set forth herein.

BACKGROUND OF THE INVENTION

Field of the Invention

The present invention relates to a display device, and more particularly, to an organic light emitting diode (OLED) display device having improved reliability by preventing defective bonding between a substrate and an encapsulation substrate.

Discussion of the Related Art

An OLED display device displays an image by adjusting an amount of light emitted from a light emitting layer. The OLED display device also have a reduced weight and volume compared to the larger cathode ray tubes (CRTs).

Further, the OLED display device is a self-emitting device using a thin light emitting layer disposed between electrodes. In more detail, the OLED includes a first electrode functioning as an anode and being connected to a thin film transistor disposed in each sub-pixel region of a substrate, a light emitting layer (EML), and a second electrode functioning as a cathode.

When a voltage is applied to the first and second electrodes of the OLED, holes and electrons are recombined in the light emitting layer to create excitons that emit light when falling from an excited state to a ground state.

However, such OLED easily deteriorates from external factors such as moisture, oxygen, UV radiation, and manufacturing conditions of the display device. In the related art OLED display devices, a substrate including the OLED and an encapsulation substrate are bonded to each other via an adhesive layer.

In more detail, FIG. 1 is a cross-sectional view illustrating defective bonding of a related art OLED display device. Referring to FIG. 1, an OLED 11 is formed on a substrate 10, and the substrate 10 is bonded to an encapsulation substrate 15 via an adhesive layer 14. For example, the adhesive layer 14 is applied to the encapsulation substrate 15, and then a cover peeling layer is removed from the adhesive layer 14 (i.e., to expose the adhesive layer 14). The encapsulation substrate 15 with the attached adhesive layer 14 is pressed or combined with the substrate 10 including the OLED 11.

However, during this joining or combining process, a step difference between a display region including OLED 11 and a non-display region not including OLED 11 is formed. That is, as show in FIG. 1, a distance D2 between the substrate 10 and the encapsulation substrate 15 in the non-display region is greater than a distance D1 between the substrate 10 and the encapsulation substrate 15 in the display region. Thus, moisture, oxygen, or other particles can enter this region and damage the OLED 11.

SUMMARY OF THE INVENTION

Accordingly, one object of the present invention is to provide an OLED display device that substantially obviates one or more problems due to limitations and disadvantages of the related art.

Another object of the present invention is to provide an OLED display device having improved reliability by preventing defective bonding of the substrate provided with an OLED and an encapsulation substrate.

To achieve these objects and other advantages and in accordance with the purpose of the invention, as embodied and broadly described herein, the present invention provides in one aspect an organic light emitting diode (OLED) display device including a substrate having a display region and a non-display region surrounding the display region; an OLED on the substrate in the display region; an encapsulation substrate bonded to the substrate via an adhesive layer such that the encapsulation substrate and the substrate face each other; and a step-difference compensation portion in the non-display region and configured to compensate for a step difference between the display region and the non-display region.

In another aspect, the present invention provides a method of manufacturing an organic light emitting diode (OLED) display device. The method includes providing a substrate having a display region and a non-display region surrounding the display region; forming an OLED on the substrate in the display region; forming an encapsulation substrate with an integrally-formed step-difference compensation portion in the non-display region for compensating for a step difference between the display region and the non-display region; and bonding to the substrate and the encapsulation substrate via an adhesive layer such that the encapsulation substrate and the substrate face each other.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Further, the thickness of the OLED 11 region is very small and thus the step difference is also small. The present inventors have advantageously determined that even though this step difference has been small, the step difference has negatively impacted the OLED 11, because moisture, etc. reaches the OLED 11 through the step difference.

An OLED display device according to an embodiment of the present invention will now be described in detail with reference to the accompanying drawings.

Figure 1:
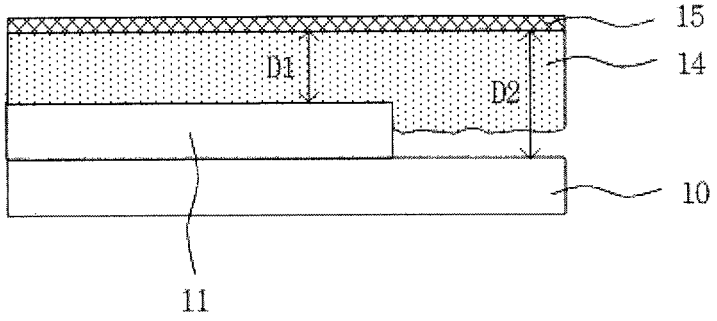
FIG. 1 is a cross-sectional view illustrating defective bonding of a related art OLED display device.
Figure 2A:
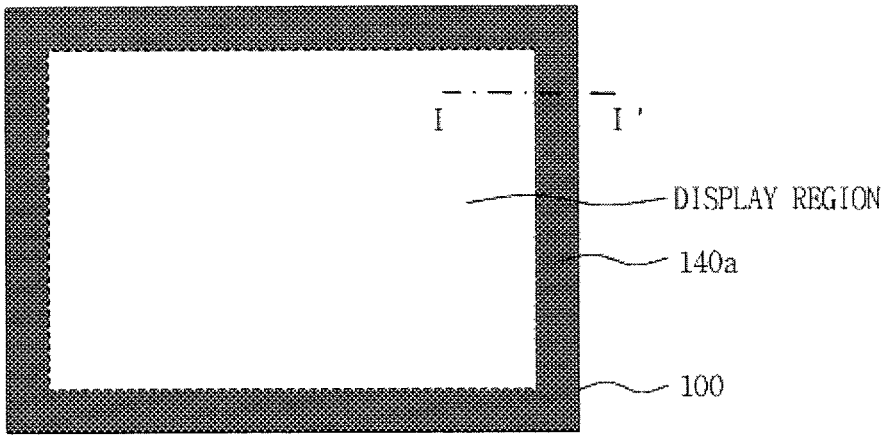
FIGS. 2A and 2B are plan views illustrating an OLED display device according to one embodiment of the present invention.
Figure 2B:
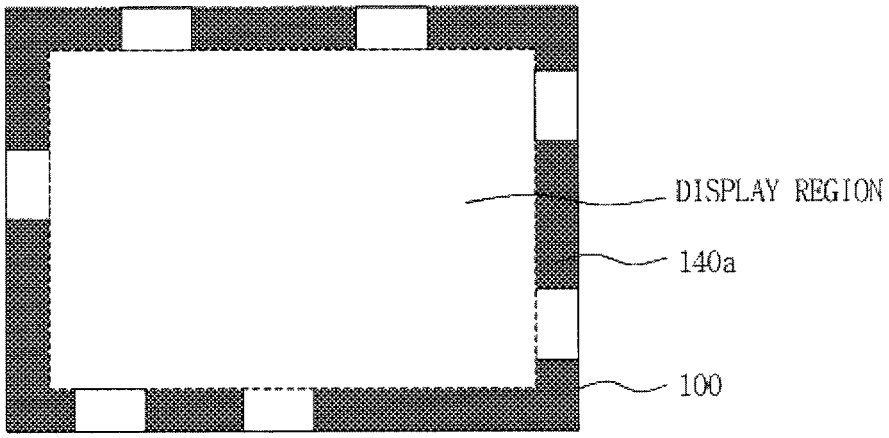
Figure 3A:
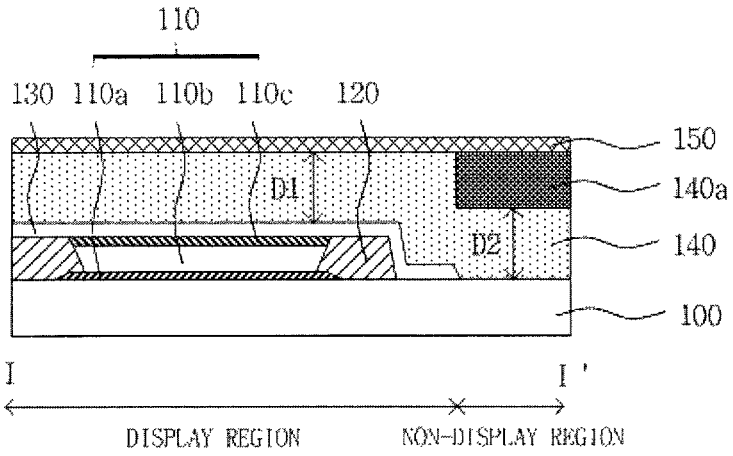
FIG. 3A is a cross-sectional view illustrating a portion of FIG. 2A taken along line I-I'.
Figure 3B:
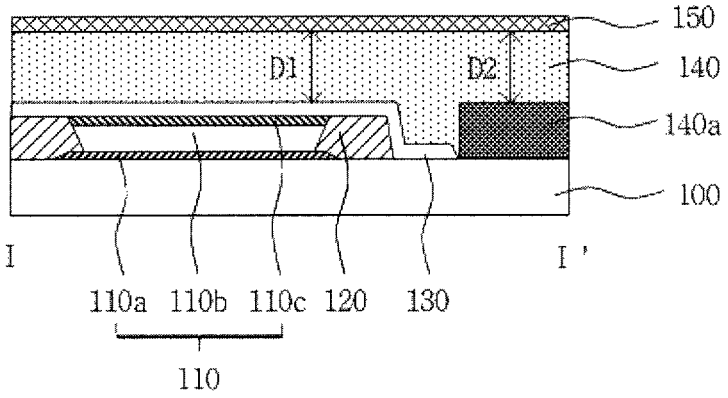
FIG. 3B is a cross-sectional view illustrating a step difference compensation portion of FIG. 2A formed on a substrate.
Figure 3C:
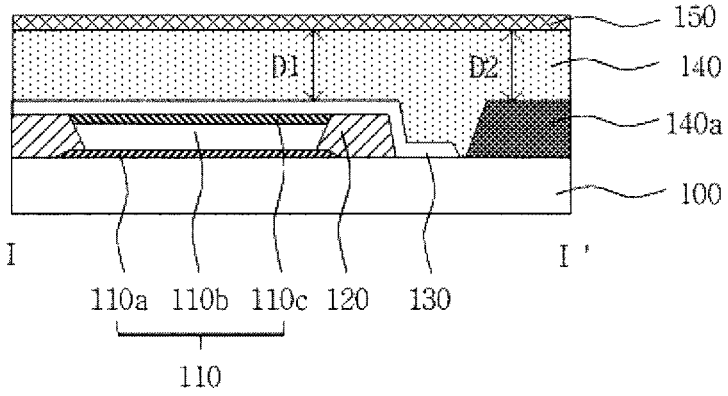
FIG. 3C is a cross-sectional view illustrating the step-difference compensation portion of FIG. 3B having an inclined surface.

FIGS. 2A and 2B are plan views illustrating an OLED display device according to one embodiment of the present invention. In particular, FIG. 2A illustrates that a step-difference compensation portion is integrally formed with the non-display region to surround a display region, and FIG. 2B illustrates that a step-difference compensation portion is partially formed. Further, FIG. 3A is a cross-sectional view illustrating a portion of FIG. 2A taken along line I-I', and FIG. 3B is a cross-sectional view illustrating a step difference compensation portion of FIG. 2A formed on a substrate. In addition, FIG. 3C is a cross-sectional view illustrating the step-difference compensation portion of FIG. 3B having an inclined surface.

Referring to FIGS. 2A and 3A, the OLED display device includes a substrate 100 having a display region and a non-display region surrounding the display region, an OLED 110 formed on the substrate 100 in the display region, an encapsulation substrate 150 bonded to the substrate 100 via an adhesive layer 140 such that the encapsulation substrate 150 and the substrate 100 face each other, and a step-difference compensation portion 140*a* formed between the encapsulation substrate 150 and the adhesive layer 140 at a portion corresponding to the non-display region.

In addition, the step-difference compensation portion 140*a* may be integrally formed with the non-display region as illustrated in FIG. 2A or partially formed in the non-display region as illustrated in FIG. 2B. Further, gate lines and data lines are formed in a matrix array in the display region of the substrate 100, and a plurality of sub-pixel regions are defined by intersections of the gate lines and data lines.

In addition, thin film transistors are respectively arranged at sub-pixel regions. The OLED 110 connected to the thin film transistor is also formed. In more detail, the OLED 110 includes a first electrode 110*a*, which is connected to the thin film transistor disposed in each sub-pixel region of a substrate, a light emitting layer 110*b*, and a second electrode 110*c*, which are sequentially laminated.

The first electrode 110*a* that constitutes an anode is formed of a transparent conductive material such as tin oxide (TO), indium tin oxide (ITO), indium zinc oxide (IZO), and indium tin zinc oxide (ITZO). A bank insulating film 120 that exposes a portion of the first electrode 110*a* is also formed over the substrate 100. In more detail, the bank insulating film 120 partitions a plurality of OLEDs and defines luminescent regions of the display region.

Then, the organic light emitting layer 110*b* and the second electrode 110*c* are sequentially formed on the first electrode 110*a* exposed by the bank insulating film 120. The light emitting layer 110*b* may be formed of a material emitting red (R), green (G), blue (B), or white (W) light in each of the sub-pixel regions. Alternatively, the light emitting layer 110*b* may be formed of a material emitting only white (W) light.

When the light emitting layer 110*b* is formed of a material emitting only white (W) light, each of the sub-pixel regions includes an R, G, or B color filter such that various colors may be realized while the white light emitted from the light emitting layer 110*b* passes through the R, G, or B color filter.

Further, the second electrode 110*c* disposed on the light emitting layer 110*b* constitutes a cathode and is formed of a reflective metallic material such as aluminum (Al) so as to reflect light emitted from the light emitting layer 110*b* toward the first electrode 110*a*. On the other hand, when the second electrode 110*c* is formed of a transparent conductive material, the first electrode 110*a* is formed of a reflective metal to reflect light emitted from the light emitting layer 110*b* toward the second electrode 110*c*.

As described above, the OLED 110 including the first electrode 110*a*, the light emitting layer 110*b*, and the second electrode 110*c*, which are sequentially laminated, emits light as holes and electrodes that are recombined in the light emitting layer 110*b* to create excitons in accordance with application of a voltage to the first and second electrodes 110*a* and 110*c*, and the excitons fall from an excited state to a ground state.

In addition, a hole injection layer and a hole transport layer may further be disposed between the first electrode 110*a* and the light emitting layer 110*b*. In more detail, the hole injection layer and the hole transport layer are used to facilitate hole injection into the light emitting layer 110*b*. Further, an electron injection layer and an electron transport layer may further be disposed between the light emitting layer 110*b* and the second electrode 110*c*. The electron injection layer and the electron transport layer are used to facilitate electron injection into the light emitting layer 110*b*.

In addition, because the OLED 110 is vulnerable to moisture and oxygen, a passivation film 130 is formed to cover the OLED 110 to block inflow of external moisture and oxygen. In the drawings, the passivation film 130 completely surrounds the OLED 110. However, the passivation film 130 may be formed only on the OLED 110.

Further, the passivation film 130 may be an inorganic film formed of at least one inorganic material selected from the group consisting of $SiO_x$, $SiN_x$, SiC, SiON, SiOC, SiONC, and amorphous carbon (a-C) or an organic film formed of at least one organic material selected from the group consisting of acrylates, epoxy polymers, and imide polymers. The passivation film 130 may also have a structure in which the inorganic layer and the organic layer are laminated at least once.

Then, the encapsulation substrate 150 is bonded to the entire surface of the substrate 100 via the adhesive layer 140. Here, the encapsulation substrate 150 may be formed of glass, plastic, or metal foil to protect the OLED 110 from external moisture, oxygen, and the like. In addition, the adhesive layer 140 for bonding the encapsulation substrate 150 to the substrate 100 may be formed of an acrylic resin, a silicone resin, or a sealant.

As discussed previously, in the related art OLED display devices, the distance D2 between the substrate 100 and the encapsulation substrate 150 in the non-display region is greater than the distance D1 between the substrate 100 and the encapsulation substrate 150 in the display region due to a step difference between the display region and the non-display region as described above.

Thus, the substrate 100 is not sufficiently covered by the adhesive layer 140. Accordingly, the non-display region of the substrate 100 cannot be sufficiently bonded to the encapsulation substrate 150, so that external moisture and oxygen can enter the OLED 110, thereby decreasing reliability.

Thus, the OLED display device according to an embodiment of the present invention includes a step-difference compensation portion 140*a* that is interposed between the encapsulation substrate 150 and the adhesive layer 140 to correspond to the non-display region, thereby compensating for the step difference between the display region and the non-display region.

The step-difference compensation portion 140*a* may be formed of a metal such as copper (Cu), aluminum (Al), and molybdenum (Mo) or an inorganic insulating material such as silicon oxide (SiO) and silicon nitride ($SiN_x$). Alternatively, the step-difference compensation portion 140*a* may be formed of an organic insulating material such as benzocyclobutene and photo acryl or a mixed material of an inorganic insulating material and an organic insulating material. In addition, the step-difference compensation portion 140*a* may have a thickness of 0.1 μm to 100 μm, preferably, 3 μm to 20 μm.

The OLED display device includes the step-difference compensation portion 140*a* formed on the encapsulation substrate 150 corresponding to the non-display region to compensate for the step difference between the display region and the non-display region. Thus, the distance D1 between the substrate 100 and the encapsulation substrate 150 in the display region is substantially equal to the distance D2 between the substrate 100 and the encapsulation substrate 150 in the non-display region.

Therefore, the entire surface of the substrate 100 is sufficiently bonded to the encapsulation substrate 150 via the adhesive layer 140. As a result, inflow of external moisture and oxygen into the OLED 110 is prevented, thereby improving the reliability of the display device.

Further, as shown in FIG. 3B, the step-difference compensation portion 140*a* may also be formed between the substrate 100 and the adhesive layer 140, instead of being disposed between the encapsulation substrate 150 and the adhesive layer 140. In this instance, the step-difference compensation portion 140*a* may be formed when forming the OLED 110. Further, as illustrated in FIG. 3C, at least one side of the step-difference compensation portion 140*a* may be inclined.

Figure 4A:
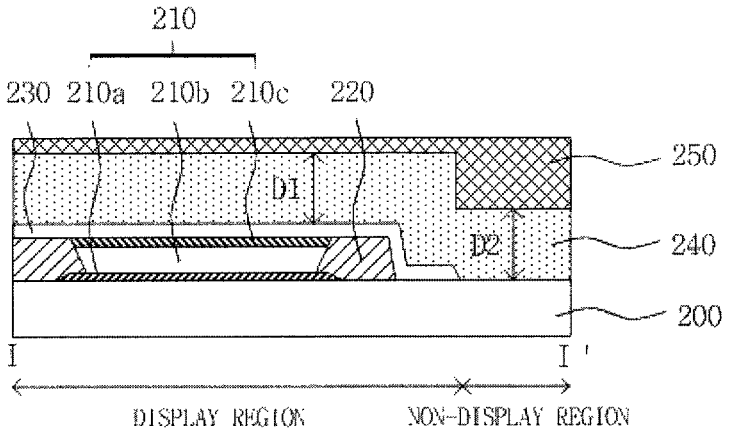
FIG. 4A is a cross-sectional view illustrating an OLED display device according to another embodiment of the present invention.
Figure 4B:
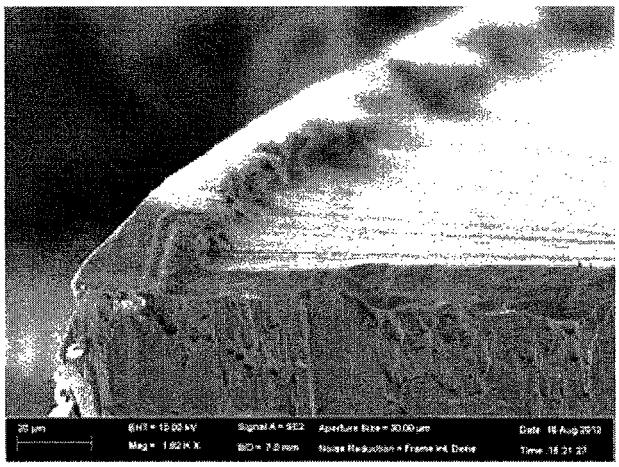
FIG. 4B is a photograph of an encapsulation substrate of FIG. 4A.

Next, FIG. 4A is a cross-sectional view illustrating an OLED display device according to a second embodiment of the present invention, and FIG. 4B is a photograph of an encapsulation substrate of FIG. 4A.

The OLED display device according to this embodiment of the present invention does not include a step-difference compensation portion. Instead, edge portions of the encapsulation substrate 250 have greater thicknesses than a central portion of the encapsulation substrate 250, so that the edge portions of the encapsulation substrate 250 function as the step-difference compensation portions.

In more detail, as illustrated in FIG. 4A, the OLED display device includes a substrate 200 having a display region and a non-display region, an OLED 210 formed on the substrate 200 in the display region, and an encapsulation substrate 250 bonded to the substrate 200 via an adhesive layer 240.

Here, edge portions of the encapsulation substrate 250 have greater thicknesses than a central portion of the encapsulation substrate 250, which corresponds to the display region. Thus, the edge portions of the encapsulation substrate 250 function as step-difference compensation portions compensating for the step difference between the display region and non-display region.

In particular, gate lines and data lines are formed in a matrix array in the display region of the substrate 200, and a plurality of sub-pixel regions are defined by intersections of the gate lines and data lines. In addition, thin film transistors are respectively arranged at sub-pixel regions. The OLED 210 connected to the thin film transistor is also formed, and includes a first electrode 210*a*, which is connected to the thin film transistor disposed in each sub-pixel region of a substrate, a light emitting layer 210*b*, and a second electrode 210*c*, which are sequentially laminated.

Then, a passivation film 230 is formed to cover the OLED 210. The encapsulation substrate 250 formed of glass or plastic can also be bonded to the entire surface of the substrate 200 via the adhesive layer 240. The encapsulation substrate 250 is also formed to protect the OLED 210 from external moisture and oxygen. The adhesive layer 240 may be formed of an acrylic resin, a silicone resin, or a sealant.

In addition, the edge portions of the encapsulation substrate 250 corresponding to the non-display region have greater thicknesses than the central portion of the encapsulation substrate 250 corresponding to the display region. In particular, the edge portions of the encapsulation substrate 250 have greater thicknesses than the central portion thereof by 0.1 μm to 100 μm, preferably, 3 μm to 20 μm.

Thus, as discussed above, the OLED display device according to the second embodiment of the present invention does not include the step-difference compensation portion at the encapsulation substrate 250 or the substrate 200 in the non-display region. As illustrated in FIG. 4B, the adhesive layer 240 has a uniform thickness between the encapsulation substrate 250 and the substrate 200 due to the thickness difference of the encapsulation substrate 250.

Thus, a distance D1 between an upper surface of the OLED 210 and the encapsulation substrate 250 is equal to a distance D2 between the non-display region of the substrate 100 in which the OLED 210 is not formed and the encapsulation substrate 150. Accordingly, in the OLED display device, the entire surface of the substrate 200 is sufficiently bonded to the encapsulation substrate 250 via the adhesive layer 240. As a result, inflow of external moisture and oxygen into the OLED 210 may be prevented, thereby improving reliability of the display device.

FIG. 4B also illustrates the edge portion of the encapsulation substrate 250 is integrally formed with the encapsulation substrate. Thus, the encapsulation substrate 250 can be formed in a single process reducing the overall costs of manufacturing the display device.

Figure 5:
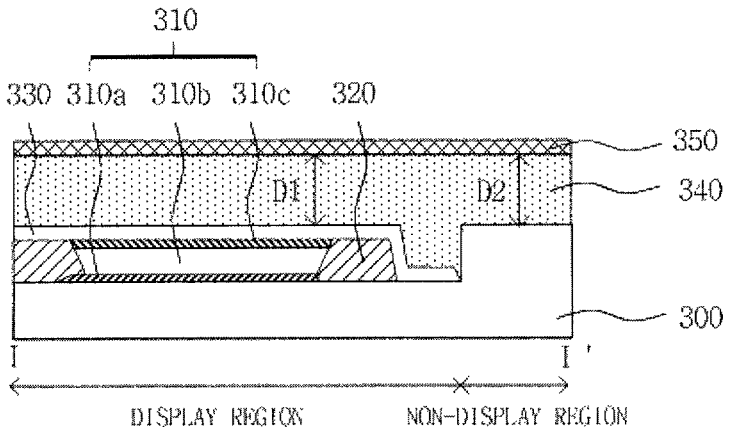
FIG. 5 is a cross-sectional view illustrating an OLED display device according to still another embodiment of the present invention.

Next, FIG. 5 is a cross-sectional view illustrating an OLED display device according to another embodiment of the present invention. In this OLED display device, an edge portion of a substrate, instead of an encapsulation substrate, has a greater thickness than a central portion thereof. Thus, edge portions of the substrate function as step-difference compensation portions.

Particularly, as illustrated in FIG. 5, the OLED display device includes a substrate 300 having a display region and a non-display region, an OLED 310 formed on the substrate 300 in the display region, and an encapsulation substrate 350 bonded to the substrate 300 via an adhesive layer 340. As shown, edge portions of the substrate 300 corresponding to the non-display region have greater thicknesses than a central portion of the substrate 300 corresponding to the display region.

Thus, the edge portions of the substrate 300 function as step-difference compensation portions that compensate for the step difference between the display region and the non-display region. Particularly, the thicknesses of the edge portions of the substrate 300 may be greater than that of the central portion thereof by 0.1 μm to 100 μm, preferably 3 μm to 20 μm. Further, the substrate 300 can be formed in a single process with the higher edge portions.

The OLED display device in this embodiment of the present invention does not include a step-difference compensation portion at the non-display region of the substrate 300 or the encapsulation substrate 350. Further, the adhesive layer 340 has a uniform thickness between the encapsulation substrate 350 and the substrate 300 due to the thickness difference of the substrate 300.

Thus, in the OLED display device according to this embodiment of the present invention, the entire surface of the substrate is sufficiently bonded to the encapsulation substrate via the adhesive layer. Therefore, inflow of external moisture and oxygen into the OLED is prevented, thereby improving the reliability of the display device.

Figure 6:
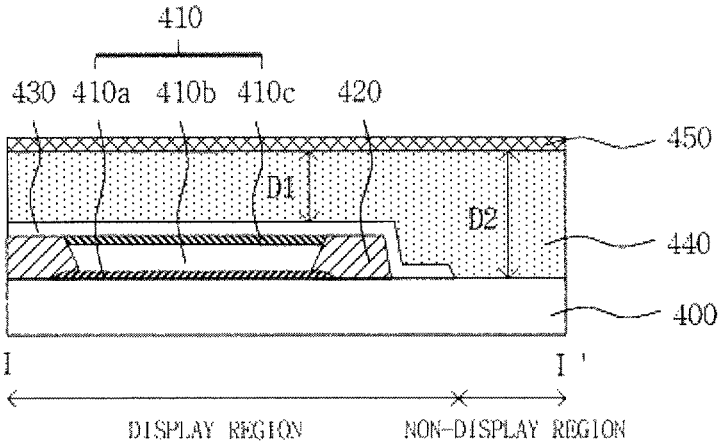
FIG. 6 is a cross-sectional view illustrating an OLED display device according to yet another embodiment of the present invention.

Next, FIG. 6 is a cross-sectional view illustrating an OLED display device according to yet another embodiment of the present invention. In this embodiment, neither the substrate nor the encapsulation substrate is changed, but the adhesive layer has different thicknesses between a display region and a non-display region.

As illustrated in FIG. 6, the OLED display device includes a substrate 400 having a display region and a non-display region, an OLED 410 formed on the substrate 400 in the display region, and an encapsulation substrate 450 bonded to the substrate 400 via an adhesive layer 440. Edge portions of the adhesive layer 440 corresponding to the non-display region have greater thicknesses than a central portion thereof corresponding to the display region.

Particularly, the thickness of the central portion of the adhesive layer 440 is equal to the distance D1 between the substrate 400 and the encapsulation substrate 450 in the display region, and the thicknesses of the edge portions of the adhesive layer 440 are equal to the distance D2 between the substrate 400 and the encapsulation substrate 450 in the non-display region. Further, the edge portions of the adhesive layer 440 have greater thicknesses than the central portion thereof by 0.1 μm to 100 μm, preferably, 3 μm to 20 μm.

Figure 7:
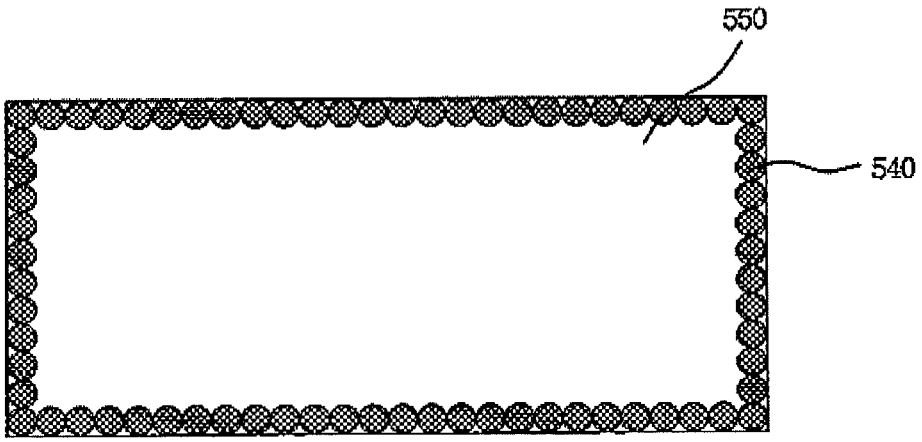
FIG. 7 is a plan view illustrating an OLED display device according to another embodiment of the present invention.

Next, FIG. 7 is an underside view of an encapsulation substrate 550 including a step-difference compensation portion according to another embodiment of the present invention. As shown, the encapsulation substrate 550 includes a step-difference compensation portion 540 formed around the bottom edges of the substrate 550. The compensation portion 540 can be formed of beads or another type of material and are preferably formed completely around the outer edges of the substrate 550 to prevent moisture or other materials from reaching the OLED.

Thus, in one example, the substrate 550 can be formed, and then compensation portion 540 can be placed on the substrate 550. For example, a glue gun can be used to place the compensation portion 540 around the edges. The encapsulation substrate 550 can then be flipped over and placed on the lower substrate including the OLED. Thus, the compensation portion 540 can be squeezed between the substrates and fill in or compensate for any step-difference.

Further, the compensation portion 540 can be beads or any material discussed above. For example, the material may be formed of a metal such as copper (Cu), aluminum (Al), and molybdenum (Mo) or an inorganic insulating material such as silicon oxide (SiO) and silicon nitride ($SiN_x$). Alternatively, the step-difference compensation portion 140*a* may be formed of an organic insulating material such as benzocyclobutene and photo acryl or a mixed material of an inorganic insulating material and an organic insulating material. In addition, the step-difference compensation portion 140*a* may have a thickness of 0.1 μm to 100 μm, preferably, 3 μm to 20 μm. When beads are used, the overall dimensions of the beads can satisfy this thickness dimension as well.

Beads also work particularly well, because they tend to expand when pressed against the lower substrate thereby creating a sufficient tension in the beads to further create a tighter seal between the substrates. FIG. 7 illustrates edges of the beads touching each other, but it is also possible to slightly separate each bead, which when pressed against the lower substrate will expand outwards so as to compete the seal between the substrates. The compensation portion 540 may also be integrally formed onto the encapsulation substrate 500 rather than added on in a separate step.

Figure 8:
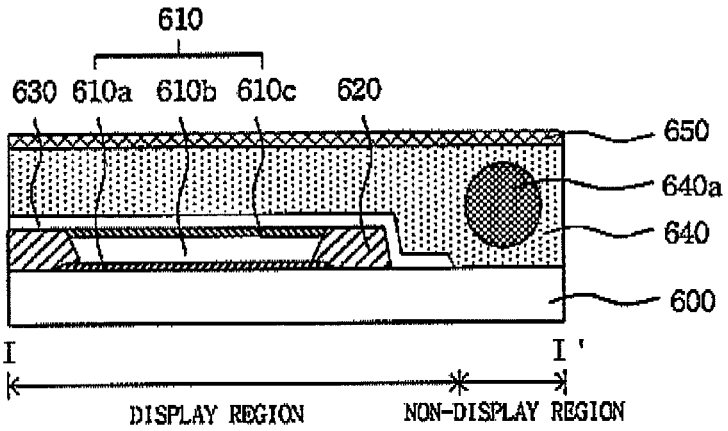
FIG. 8 is a cross-sectional view illustrating an OLED display device according to still another embodiment of the present invention.

Next, FIG. 8 is a cross-sectional view illustrating an OLED display device according to yet another embodiment of the present invention. In particular, FIG. 8 is similar to FIG. 6 but includes a compensation portion 640*a*. As illustrated in FIG. 6, the OLED display device includes a substrate 600 having a display region and a non-display region, an OLED 610 formed on the substrate 600 in the display region, and an encapsulation substrate 650 bonded to the substrate 600 via an adhesive layer 640. Edge portions of the adhesive layer 640 corresponding to the non-display region also include the compensation portion 640*a*.

In addition, the components in FIG. 8 are similar to the components shown in FIG. 3A, for example, except use corresponding numbers in the 600 range. Accordingly, detailed descriptions of the additional elements in FIG. 8 are not repeated here. Further, the step-difference compensation portion 640*a* is interposed within the adhesive layer 640 to correspond to the non-display region, thereby compensating for the step difference between the display region and the non-display region.

The step-difference compensation portion 640*a* may be formed of a metal such as copper (Cu), aluminum (Al), and molybdenum (Mo) or an inorganic insulating material such as silicon oxide (SiO) and silicon nitride ($SiN_x$). Alternatively, the step-difference compensation portion 140*a* may be formed of an organic insulating material such as benzocyclobutene and photo acryl or a mixed material of an inorganic insulating material and an organic insulating material.

The OLED display device in this embodiment includes the step-difference compensation portion 640*a* formed on within the adhesive layer 640 corresponding to the non-display region to compensate for the step difference between the display region and the non-display region. Thus, a strong bond is created between the adhesive layer and the compensation portion 640*a*.

Therefore, the entire surface of the substrate 600 is sufficiently bonded to the encapsulation substrate 650 via the adhesive layer 640 and compensation portion 640*a*. As a result, inflow of external moisture and oxygen into the OLED 610 can be prevented, thereby improving the reliability of the display device.

The present invention also related to a method of manufacturing an organic light emitting diode (OLED) display device. For example, the method includes providing a substrate 100, 200, 300, 400, 600 etc. having a display region and a non-display region surrounding the display region; forming an OLED 110, 210, 310, 410, 610, etc. on the substrate in the display region; forming an encapsulation substrate 150, 250, 350, 450, 650, etc. with an integrally-formed step-difference compensation portion in the non-display region for compensating for a step difference between the display region and the non-display region; and bonding to the substrate and the encapsulation substrate via an adhesive layer 140, 240, 340, 440, 640 such that the encapsulation substrate and the substrate face each other. Further, the integrally-formed step-difference compensation portion is preferably formed entirely around edges of the encapsulation substrate as shown in FIG. 4B. Further, the other substrate 100 can be integrally formed with the step-difference compensation portion.

As is apparent from the above description, according to the OLED display device according to the present invention, the step difference between the display region and the non-display region may be compensated for by forming the step-difference compensation portion between the encapsulation substrate and the adhesive layer or between the substrate and the adhesive layer in the non-display region, or by varying the thickness of the adhesive layer. Accordingly, the entire surface of the substrate is sufficiently bonded to the encapsulation substrate via the adhesive layer, so that inflow of external mixture and oxygen into the OLED may be prevented, thereby improving reliability.

The present invention encompasses various modifications to each of the examples and embodiments discussed herein. According to the invention, one or more features described above in one embodiment or example can be equally applied to another embodiment or example described above. The features of one or more embodiments or examples described above can be combined into each of the embodiments or examples described above. Any full or partial combination of one or more embodiment or examples of the invention is also part of the invention.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An organic light emitting diode (OLED) display device, comprising:

a substrate having a display region and a non-display region surrounding the display region;

an OLED on the substrate in the display region;

an adhesive layer on the OLED and over the substrate including the display region and the non-display region;

an encapsulation substrate bonded, via the adhesive layer, to the substrate in the display region and the non-display region such that the encapsulation substrate and the substrate face each other; and a step-difference compensator interposed between the encapsulation substrate and the substrate to correspond to the non-display region and configured to compensate for a step difference between the display region and the non-display region, wherein a distance between an upper surface of the OLED and the encapsulation substrate in the display region is substantially equal to a distance between the substrate and the step-difference compensator in the non-display region when the step-difference compensator is formed between the encapsulation substrate and the adhesive layer, and wherein the distance between the upper surface of the OLED and the encapsulation substrate in the display region is substantially equal to a distance between the encapsulation substrate and the step-difference compensator when the step-difference compensator is formed between the substrate and the adhesive layer.

2. The OLED display device according to claim 1, wherein the step-difference compensator is integrally formed with the encapsulation substrate and, the step-difference compensator and the encapsulation substrate is a single body.

3. The OLED display device according to claim 1, wherein a thickness of a portion of the encapsulation substrate corresponding to the non-display region is greater than a thickness of a portion of the encapsulation substrate corresponding to the display region by 0.1 μm to 100 μm.

4. The OLED display device according to claim 1, wherein the step-difference compensator is coincidently formed with the non-display region and completely surrounds the display region.

5. The OLED display device according to claim 1, wherein the step-difference compensator includes a material selected from the group consisting of a metal, an inorganic insulating material, and an organic insulating material or a mixed material of an inorganic insulating material and an organic insulating material.

6. The OLED display device according to claim 1, wherein the step-difference compensator has a thickness of 0.1 μm to 100 μm.

7. The OLED display device according to claim 1, wherein the step-difference compensator is integrally formed with the substrate.

8. The OLED display device according to claim 7, wherein a thickness of a portion of the substrate corresponding to the non-display region is greater than a thickness of a portion of the substrate corresponding to the display region by 0.1 μm to 100 μm.

9. The OLED display device according to claim 1, wherein the step-difference compensator has at least one inclined surface.

10. A method of manufacturing an organic light emitting diode (OLED) display device, the method comprising:

providing a substrate having a display region and a non-display region surrounding the display region;

forming an OLED on the substrate in the display region;

forming an adhesive layer on the OLED and over the substrate in the display region and the non-display region;

forming a step-difference compensator interposed between an encapsulation substrate and the substrate to correspond to the non-display region for compensating for a step difference between the display region and the non-display region; and bonding, via the adhesive layer, the encapsulation substrate to the substrate, wherein a distance between an upper surface of the OLED and the encapsulation substrate in the display region is substantially equal to a distance between the substrate and the step-difference compensator in the non-display region when the step-difference compensator is formed between the encapsulation substrate and the adhesive layer, and wherein the distance between the upper surface of the OLED and the encapsulation substrate in the display region is substantially equal to a distance between the encapsulation substrate and the step-difference compensator when the step-difference compensator is formed between the substrate and the adhesive layer.

11. The method according to claim 10, wherein the step-difference compensator is formed entirely around edges of the encapsulation substrate.

12. The method according to claim 10, wherein a height of the step-difference compensator is 0.1 μm to 100 μm.

13. The method according to claim 10, wherein the step-difference compensator has at least one inclined surface.

14. The OLED display device according to claim 1, wherein the step-difference compensator includes beads.

15. The OLED display device according to claim 1, wherein a thickness of the step-difference compensator is greater than a thickness of the encapsulation substrate.

16. The OLED display device according to claim 1, wherein a thickness of the step-difference compensator is substantially equal to the step difference between the display region and the non-display region.

17. The method according to claim 10, wherein a thickness of the step-difference compensator is greater than a thickness of the encapsulation substrate.

18. The method according to claim 10, wherein a thickness of the step-difference compensator is substantially equal to the step difference between the display region and the non-display region.

19. The OLED display device according to claim 1, wherein a thickness of the adhesive layer in the non-display region above or below the step-difference compensator and a thickness of the adhesive layer in the display region above the OLED are substantially equal.

20. The method according to claim 10, wherein a thickness of the adhesive layer in the non-display region above or below the step-difference compensator and a thickness of the adhesive layer in the display region above the OLED are substantially equal.

* * * * *